US009380817B1

(12) United States Patent
Drake

(10) Patent No.: US 9,380,817 B1
(45) Date of Patent: Jul. 5, 2016

(54) FINGER LOOP PALM PROTECTOR

(71) Applicant: THE NATURAL GRIP LLC, Louisville, KY (US)

(72) Inventor: Justin L. Drake, Louisville, KY (US)

(73) Assignee: THE NATURAL GRIP LLC, Louisville, KY (US)

( * ) Notice: Subject to any disclaimer, the term of this patent is extended or adjusted under 35 U.S.C. 154(b) by 350 days.

(21) Appl. No.: 14/247,752

(22) Filed: Apr. 8, 2014

(51) Int. Cl.
*A41D 13/00* (2006.01)
*A41D 13/08* (2006.01)

(52) U.S. Cl.
CPC ..... *A41D 13/082* (2013.01)

(58) Field of Classification Search
CPC ... A41D 13/087; A41D 13/081; A41D 13/08; A41D 13/084; A41D 13/088; A63B 23/16; A63B 23/14
USPC ..... 2/16, 20, 21, 163; 482/47, 48, 49, 139
See application file for complete search history.

(56) References Cited

U.S. PATENT DOCUMENTS 3,178,724 A * 4/1965 Perschke ..... A41D 13/082 2/16
3,381,304 A 5/1968 Coco
3,612,521 A * 10/1971 Wendeborn ..... A63B 23/16 482/48
D256,401 S * 8/1980 Adams ..... D29/113
4,287,609 A 9/1981 Amadeo
5,064,198 A * 11/1991 Szabo ..... A63B 69/0059 473/213
5,135,217 A * 8/1992 Swain ..... A63B 69/0071 473/450
5,348,531 A * 9/1994 Brown ..... A63B 21/0004 601/40
5,466,215 A * 11/1995 Lair ..... A61F 5/0118 128/878
5,916,187 A * 6/1999 Brill ..... A61F 5/0118 128/879
6,360,684 B1 * 3/2002 Quaglia ..... A63B 71/0036 116/222
8,887,313 B2 * 11/2014 McGuin ..... A61F 5/0111 2/16
8,998,153 B2 * 4/2015 Lucas ..... A47B 21/0371 2/16
2013/0198920 A1 8/2013 Wittman

OTHER PUBLICATIONS

Rod Zilla; Making Hand Wraps for CrossFit—Plano CrossFit Alpha 1 Athlete; https://www.youtube.com/watch?v=x1xqdyFP2kM; Published on Jun. 22, 2013; Website printout Jan. 21, 2015.
JAW Pullup Grips; http://store.justanotherwod.com/jaw-pullup-grips/; pp. 1-5; 2014; JAW.
Amazon.com: hand grips crossfit; http://www.amazon.com/s/?ie=UTF8&keywords=hand+grips+crossfit&tag=mh0b-20&index=aps&hvadid=2478175700&ref=pd_sl_3nhcyw98sd_ee; pp. 1-5.
Harbinger Palm Grips; HumanX by Harbinger Palm Grips; http://www.roguefitness.com/humanx-by-harbinger-palm-grips.php; pp. 1-3; 2010-13; Rogue Fitness.
Rogue Gymnastics Grips—Gray; Rogue V2 Gymnastics Grips; http://www.roguefitness.com/rogue-v2-gymnastic-grips.php; pp. 1-3; 2010-13; Rogue Fitness.
(Continued)

*Primary Examiner* — Khaled Annis
(74) *Attorney, Agent, or Firm* — Wyatt, Tarrant & Combs, LLP; Stephen C. Hall

(57) ABSTRACT

A palm protector with finger loop assemblies comprises strips of material suitable for use as a hand wrap and arranged in an articulated configuration having a shared overlay region secured by a reinforcing adhesive strip, with the strips in the articulated configuration forming finger loop openings the size of which is associated with a measurement of a finger of a user.

12 Claims, 16 Drawing Sheets

(56) References Cited

OTHER PUBLICATIONS

Rogue Gymnastics Grips; http://www.roguefitness.com/bodyweight-gymnastics/gymnastics/grips.php; pp. 1-2; 2010-13; Rogue Fitness.

RIG WRECKERS—Crossfit Grips; More Reps Less Rips; http://rigwreckers.com/; pp. 1-2; 2014 RIG WRECKERS.

Gymnastics Grips, Wrist Supports, and Accessories; US Glove Inc. is an American Manufacturer of High Quality Gymnastics Grips, Wrist Supports & Accessories; http://www.usglove.com/; pp. 1-2; 2014; US Glove.

* cited by examiner

FINGER LOOP PALM PROTECTOR

RELATED APPLICATIONS AND/OR CLAIM OF PRIORITY

None.

FIELD OF INVENTION

The subject application concerns an apparatus for protecting the palms of the hands from repetitive rubbing during competitive or other similar activities, which serves to limit or avoid certain problems such as callouses on the palms, chafing, and pressure sores that may otherwise arise.

BACKGROUND

Various physical activities require incessant use of the hands in grasping or hanging from bars or other objects. Examples include gymnastics, as well as fitness competitions that employ the use of bars for pull-ups and similar events. In such activities, grasping a bar or another object repetitively can cause rubbing, callouses, chafing, and even pressure sores on the palm of the hand. This is especially true when the weight of the individual is supported by the arms and focused on the hands in contact with the bar or the similar object, e.g., when doing pull-ups.

Fitness competitions are becoming increasingly popular in this country. Examples of the way the hands are used repetitively in such competitions include, but are not limited, to week-long fitness competitions. Some of the elite competitions put the male and female athletes through 20 or more tests of strength and endurance that require them to perform extensive gymnastic movements as well as Olympic barbell movements. Each of these individual tests during the week requires gripping and hand rotation on the bar. In each case, the potential result is the occurrence of pressure sores, chafing, callouses, and the like on the palms from such extended and repetitive use.

Gloves provide inadequate protection to the user because they are bulky, they hinder the user's grip, and they allow for the hands to become overly sweaty during training and competition. In addition to those negative aspects, gloves tend to have a generic fit and are not customized for the individual user. This presents a proper size and fit issue for a majority of people who try to utilize workout gloves during their training and competition.

Likewise, some have tried wrapping the hands with conventional athletic tape, such as a low grade 250 tensile strength latex tape. However, this approach also has substantial limitations, mainly because it is not protective during the entire workout, nor is it reusable after the workout, and it is prone to slippage during use especially as the user perspires.

In view of these problems and limitations, there is a need for a reliable palm protector that can be used during the above-mentioned activities and other similar activities. Needed features of such a palm protector include the reduction or prevention of excessive wear on the palms (i.e., avoidance or limitation of pressure sores, callouses, and the like from incessant grasping of bars and other equipment during training and competition), a customizable fit for an individual user's hand/palm/finger size and dimensions, reusability, and the reduction of the amount of sweating and prevention of overheating by not covering the entire hand.

SUMMARY OF INVENTION

The embodiments described herein meet the objectives stated in the previous section. A finger loop palm protector is created for use on each hand, and protects the palms of the hands against chafing, rubbing, and other problems that otherwise occur during activities.

Each finger loop palm protector provides durable, customized (to the individual user's hand size), and reusable protection. Each has a multiplicity of layers of material. Embodiments include those having ten layers or more of material over a portion of a user's palm, which protects the palm from the object being grasped or otherwise used during the activity. To manufacture the protectors, a simple base strip of material is used as starting material, and other readily accessible materials such as standard athletic tape can be employed to secure and reinforce the final structure. The solutions provided herein work much better than gloves, and are customized to a user's own hand size by corresponding the size of the palm protector to a measured dimension of the user's finger, e.g., ring-finger size.

BRIEF DESCRIPTION OF THE DRAWINGS

The drawings and embodiments described herein are illustrative of multiple alternative structures, aspects, and features of the present embodiments, and they are not to be understood as limiting the scope of present embodiments. It will be further understood that the drawing figures described and provided herein are not to scale, and that the embodiments are not limited to the precise arrangements and instrumentalities shown.

MULTIPLE EMBODIMENTS AND ALTERNATIVES

Figure 1:
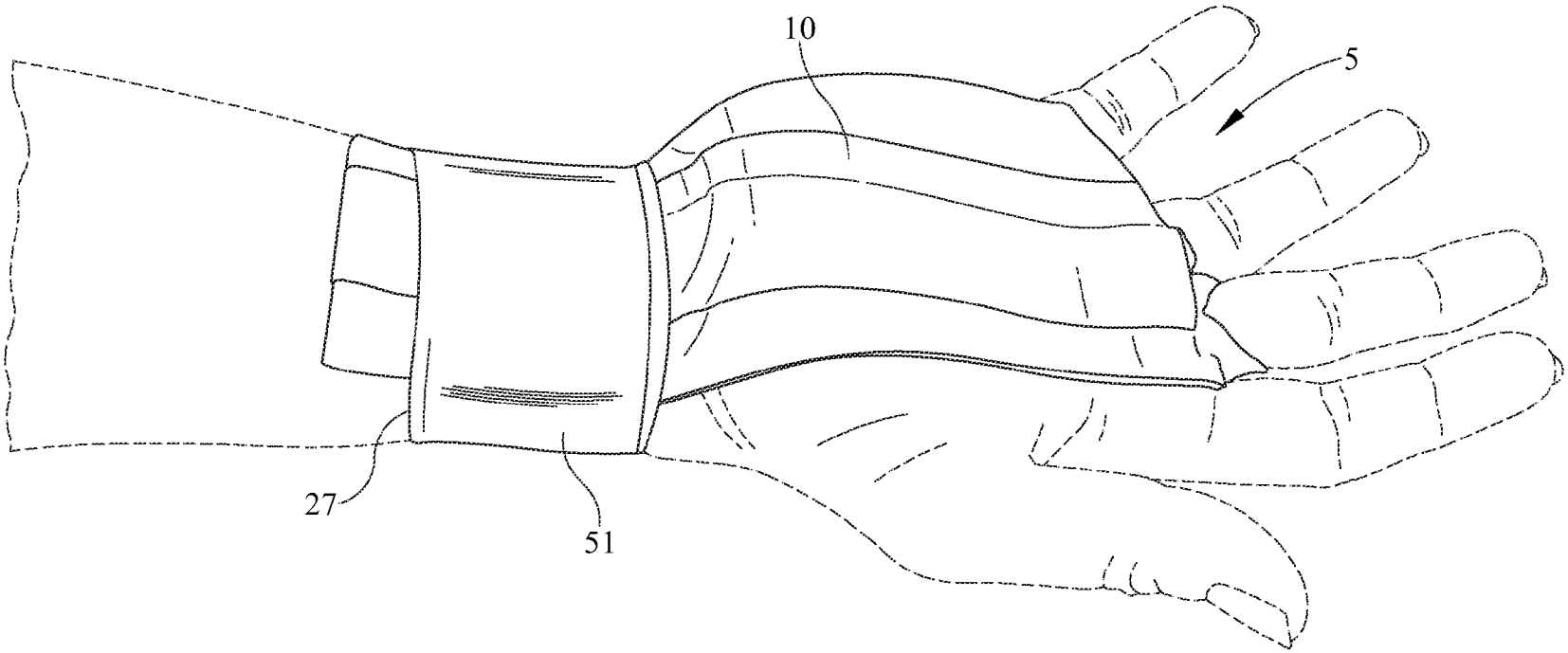
FIG. 1 is a perspective view of a finger loop palm protector worn on a user's hand, according to multiple embodiments and alternatives.

FIG. 1 shows the finger loop palm protector 5 as it would be worn by a user. The ring and middle fingers are positioned through the finger loop opening 12 (which is not visible in FIG. 1 because of the fingers, but is prominently displayed in other figures as described below). In FIG. 1, an object-facing surface 10 of the finger loop palm protector 5 is visible. This surface is for taking the brunt of frictional forces with the grasped object, thereby limiting the rubbing, chafing, callouses, and the like, which the palm would otherwise be exposed to. The finger loop palm protector 5 also has a wrist edge 27 located distally to opening 12, and around which is secured a section of wrist tape 51 (not claimed) for attaching that end to the user's wrist. The wrist tape securely wrapped around a user's wrist at the wrist edge 27 of the palm protector provides a second fixed point (in addition to the insertion of fingers through finger loop openings), thus providing a snug fit to the fingers, hand, and palm. This limits the amount of movement or slipping of the palm protector 5 during use.

Figure 2:
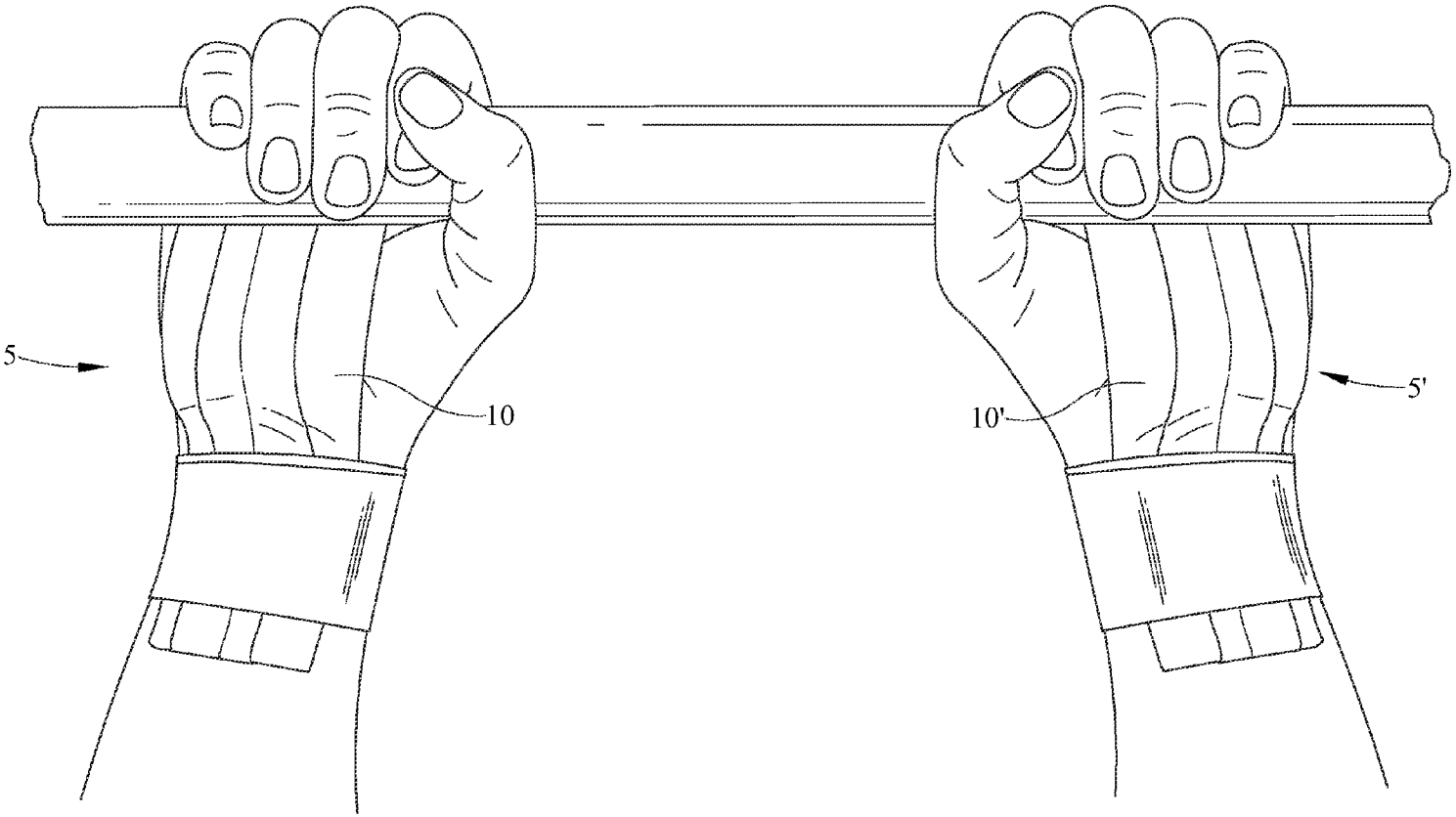
FIG. 2 is a perspective view of a finger loop palm protector worn on both of a user's hands during an activity, according to multiple embodiments and alternatives.

FIG. 2 illustrates a finger loop palm protector 5 on a user's right hand, with object-facing surface 10 visible, as the user is grasping a bar during exercise or competition. An identical finger loop palm protector 5' according to these embodiments (with its own object-facing surface 10' visible) is also shown in this figure, as worn by the user on the left hand.

Figure 3A:
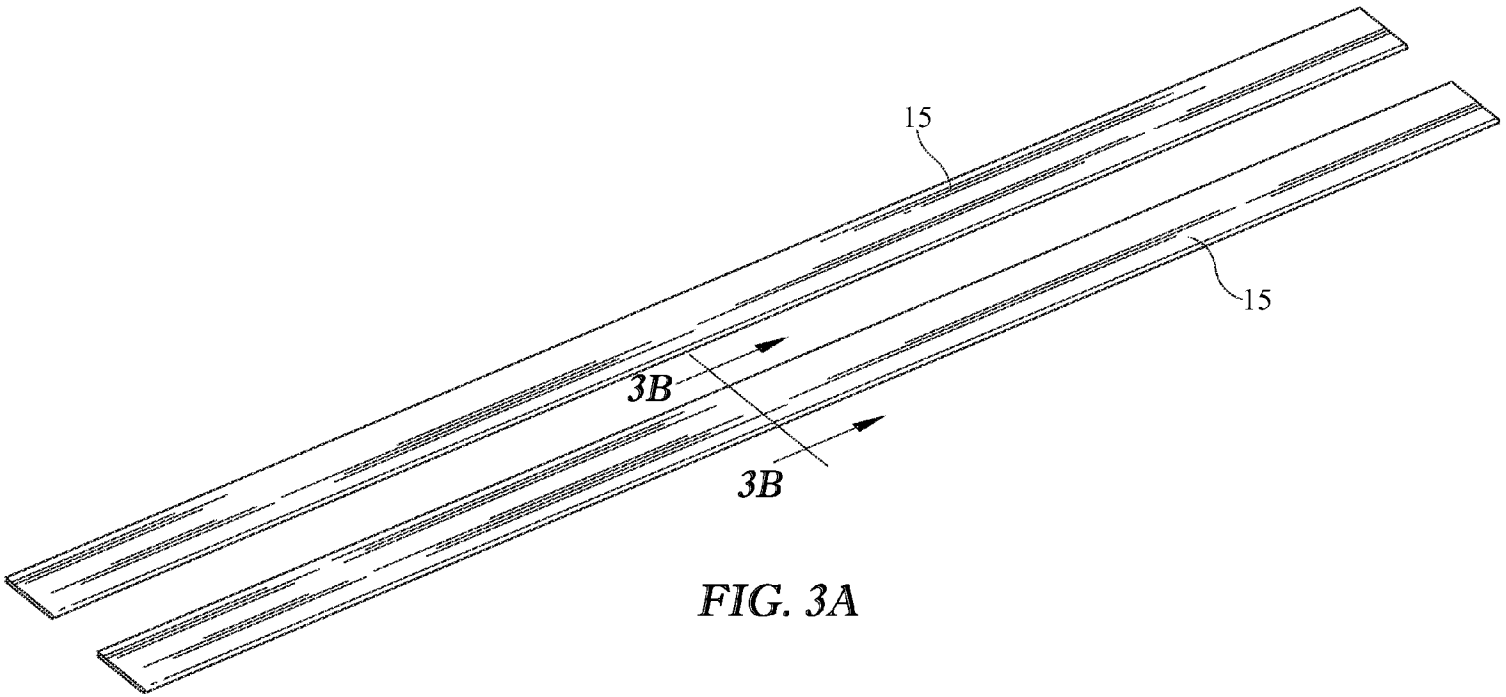
FIG. 3A is an elevation view of base strips as starting materials for a finger loop palm protector, according to multiple embodiments and alternatives.

FIG. 3A illustrates two separate base strips 15, either or both of which can be used as starting pieces for the formation of a finger loop assembly (or, assemblies 35, 45) as further described below. In some embodiments, one strip 15 is placed directly atop the other forming a double layered base strip. Alternatively, either strip 15 is folded under so the edges meet, with the fold taking place at or substantially near a midpoint 18 (seen in FIG. 4A) according to directional arrow 20. It is not a requirement to double layer the base strip 15 prior to forming a finger loop assembly; however, double layering as described above is preferred.

In some embodiments, base strip 15 is formed from a material suitable for use as a hand wrap, e.g., 100% cotton, latex-free adhesive athletic tape. In some embodiments, the materials for base strip 15 has an adhesive coating applied to one surface, and is either double layered or doubled under (e.g., in either case with adhesive surfaces facing each other). The objective is for there to be no externally exposed adhesive (or as little as possible exposed) at the beginning stages of forming the finger loop assembly.

Figure 3B:
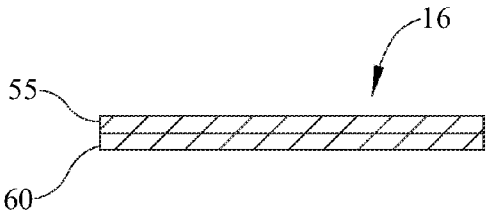
FIG. 3B is a cross-section view of a base strip as starting material for a finger loop palm protector, according to multiple embodiments and alternatives.
Figure 4A:
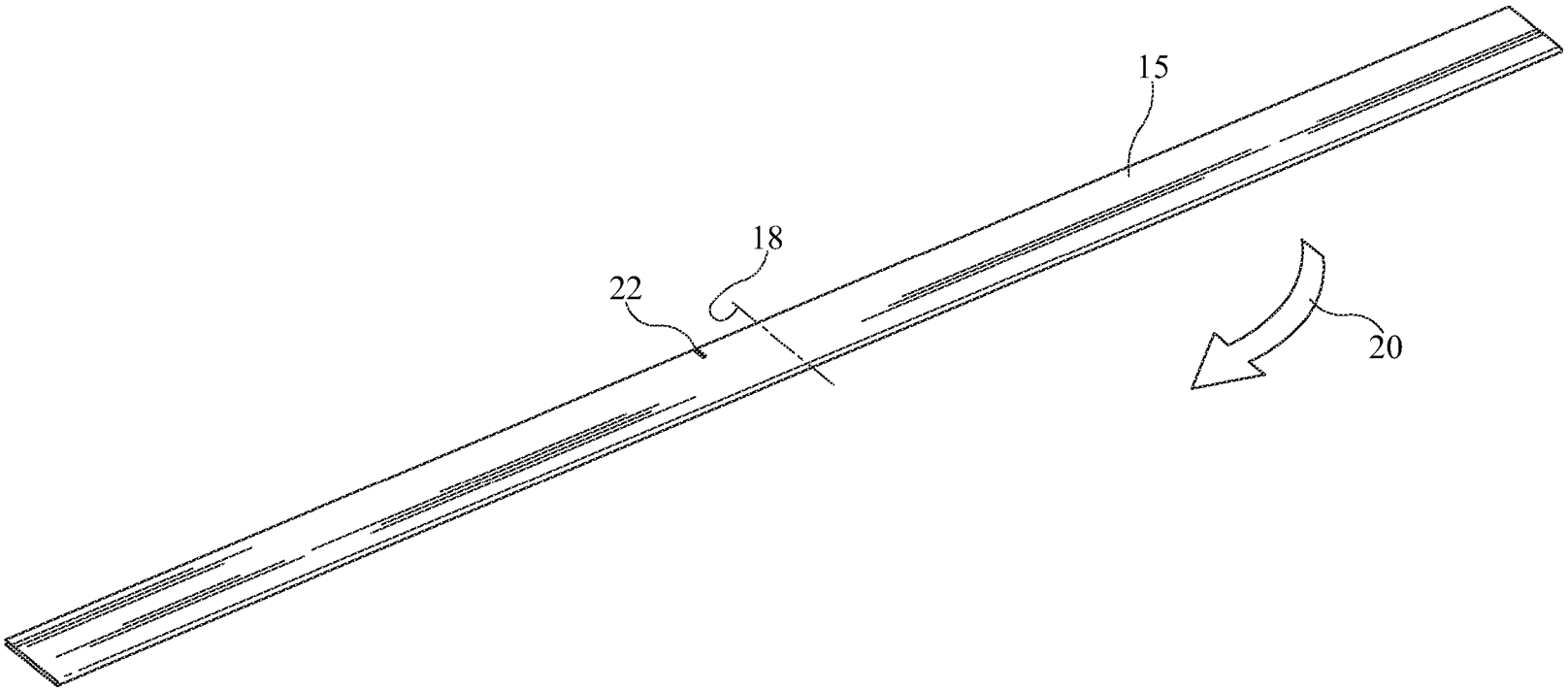
FIG. 4A is an elevation view of a base strip as starting material for a finger loop palm protector, according to multiple embodiments and alternatives.

FIG. 3B is a cross-section view of the base strip 16, again in the second, articulated configuration in accordance with the above-mentioned maneuver. This cross-section is taken along the line 3B-3B as shown in FIG. 3A. In some embodiments, as shown in the cross-section view of FIG. 3B, the strip is doubled, having a first base layer 55 and a second base layer 60. As previously noted, one way to accomplish this is by doubling under base strip 15 as depicted in FIG. 4A (including directional arrow 20, in this instance). Another way of accomplishing double thickness, again non-limiting, is by attaching two adhesive strips with the adhesive surfaces facing.

FIG. 4A further illustrates the base strip 15 from which a finger loop assembly is formed. The remainder of the description herein of FIG. 4A is as illustrated in that view, and without involvement of directional arrow 20. In this figure, an imaginary midpoint 18 of the base strip is represented as a broken line. Midpoint 18 is located exactly or approximately equidistant, as desired, from the two far ends of strip 15. A notch 22 is formed upon base strip 15 in a position selected in relation to midpoint 18. In some embodiments, the notch 22 is formed by making a mark either with pencil lead or ink in the desired location. Alternatively, the notch 22 can be cut with a blade, or through other techniques of marking its location. As described below, in some embodiments, notch 22 is used in locating an origin 32 of finger loop opening 12.

As will also be shown below, in some embodiments a finger loop assembly 35 comprises one strip corresponding to the user's ring finger (i.e., the finger closest to the pinkie), and a separate strip corresponding to the third finger (i.e., middle finger of the hand). For each finger, there is a finger loop opening 12 through which the finger is inserted. For purposes of customizing the finger loop assembly 35 to the individual's size, as a first step a dimension of the finger of the intended user is measured Optionally, the measured dimension is ring-finger size, which correlates to the circumference of the ring finger and is determined through techniques known to persons in the art of sizing and selling rings and bands.

Given there are two fingers involved, it must also be appreciated that a user's ring finger will be slightly shorter than the third finger. For smaller ring sizes (e.g., ¾, ⅚, and ⅞, respectively), a 15-inch strip is selected and/or cut for a base strip 15 corresponding to the ring finger. For larger ring-finger sizes, (9/10, 11/12, 13/14, and 15/16) a longer, 17-inch strip is selected and/or cut for the base strip 15 corresponding to the ring finger. For the third finger, the length of the strip is increased by about one-half inch, e.g., 15½ in. strip for the smaller ring-finger sizes, and 17½ in. for larger sizes. The embodiments are not limited by the initial length chosen for the base strip 15, but it has been found that these lengths are suitable.

In some embodiments, the measured dimension of the finger is associated with the positioning upon the strip 15 of the aforementioned notch 22. Accordingly, the following tables are used in certain embodiments to associate the ring-finger size with a distance in millimeters between the notch 22 and the midpoint 18 of base strip 15:

TABLE 1

Positioning the notch for the Ring Finger strip (i.e., base strip 15 to be formed into a finger loop assembly 35, having a loop opening 12 through which the ring finger will be inserted):

| Ring-finger size | Distance of notch from midpoint 18 of 15-inch strip |
|---|---|
| 3/4 (i.e., size 3 or 4) | 23 millimeters (mm) |
| 5/6 | 26 mm |
| 7/8 | 29 mm |

TABLE 1-continued

| Positioning the notch for the Ring Finger strip (i.e., base strip 15 to be formed into a finger loop assembly 35, having a loop opening 12 through which the ring finger will be inserted): | |
|---|---|
| Ring-finger size | Distance of notch from midpoint 18 of 17-inch strip |
| 9/10 (i.e., size 9 or 10) | 31 mm |
| 11/12 | 34 mm |
| 13/14 | 36 mm |
| 15/16 | 39 mm |

TABLE 2

| Positioning the notch for the Third Finger strip (i.e., base strip 15 to be formed into a finger loop assembly 35, having a loop opening 12 through which the third finger will be inserted): | |
|---|---|
| Ring finger size | Distance of notch from midpoint 18 of 15.5 in. strip |
| 3/4 | 26 mm |
| 5/6 | 29 mm |
| 7/8 | 32 mm |
| Ring finger size | Distance of notch from midpoint 18 of 17.5 in. strip |
| 9/10 | 34 mm |
| 11/12 | 37 mm |
| 13/14 | 39 mm |
| 15/16 | 42 mm |

Preferably, though not required, the ring-finger size is used for locating notch 22 on both the ring finger strip and the third finger strip.

To further illustrate, with reference to FIG. 4A (disregarding directional arrow 20 for these purposes), suppose base strip 15 was a 15-inch strip intended for the ring finger of a user with a ring-finger size of 5/6. In this way, the ring finger size would predetermine that it is appropriate to form notch 22 at a distance of 26 mm from the midpoint 18. For the same user, with respect to the Third Finger base strip, the notch would be formed 29 mm from the midpoint. The greater this distance, the larger the area of the finger loop opening 12. Thus, the area of that opening varies proportionally in accordance with the distance between the notch and the midpoint of the base strip.

Figure 4B:
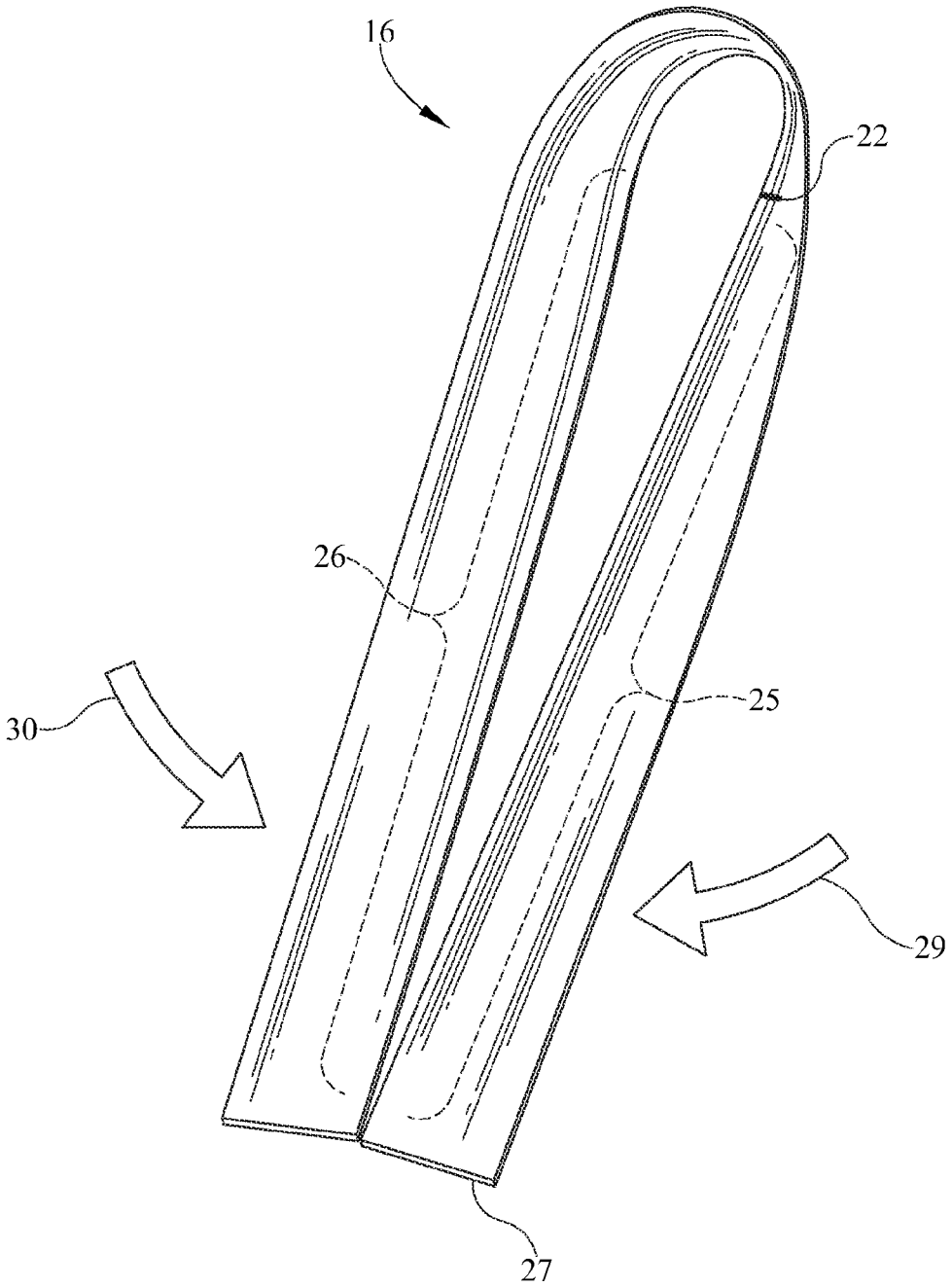
FIG. 4B is a perspective view of a base strip for a finger loop palm protector, according to multiple embodiments and alternatives.
Figure 4C:
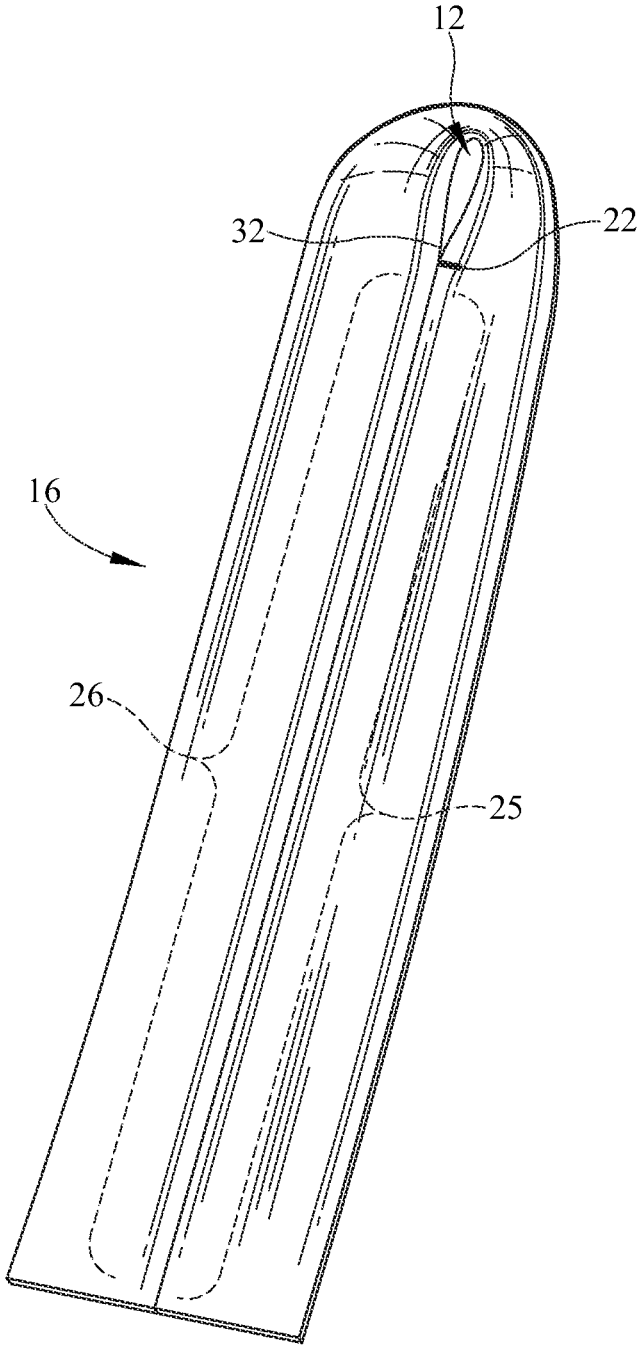
FIG. 4C is a perspective view of a base strip for a finger loop palm protector, according to multiple embodiments and alternatives.

FIG. 4B shows the beginning of the maneuver by which a base strip 15, in its initial configuration, is converted to a base strip in a second, articulated configuration 16. To delineate the second configuration of the base strip, the numeral 16 is used. In addition to notch 22 shown in this figure, base strip 16 comprises a first articulating edge region 25 and a second articulating edge region 26. The maneuver includes pivoting a portion of base strip 16 that includes second articulating edge region 26 about the midpoint 18, in a first articulating direction denoted by arrow 30. As this is done, the articulating edge regions 26, 25 are brought closer and eventually into actual or substantial contact with each other as illustrated in FIG. 4C. A second articulating direction arrow 30 denotes the movement of the first articulating edge region 25 relative to the second region, 26. Substantial contact means either actually joined, or close enough to be indirectly joined by operational engagement with a securing adhesive strip 33 as discussed below. An appropriate gap separating edge regions 25, 26 before engagement with securing adhesive strip 33 is preferably no more than about 2 mm. However, it is preferable that the edges associated with the 25 and the 26, respectively, are in actual contact with each other.

FIG. 4C shows a base strip 16, including first articulating edge region 25 and second articulating edge region 26, in actual contact with each other, and the finger loop opening 12 positioned distal to wrist edge 27 (identified in FIG. 4B). In some embodiments, as shown in several figures including FIG. 4C, notch 22 corresponds to the location of a loop origin 32 for the finger loop opening 12. This correspondence is brought about by contacting (or, bringing into substantial contact) edge regions 26, 25 from the point of wrist edge 27 up to notch 22. By limiting such contact to an area between wrist edge 37 and notch 22, a loop opening 12 is formed having notch 22 as its origin, 32, the opening 12 being located distal to the wrist edge 27 and configured for insertion of a user's finger.

Figure 4D:
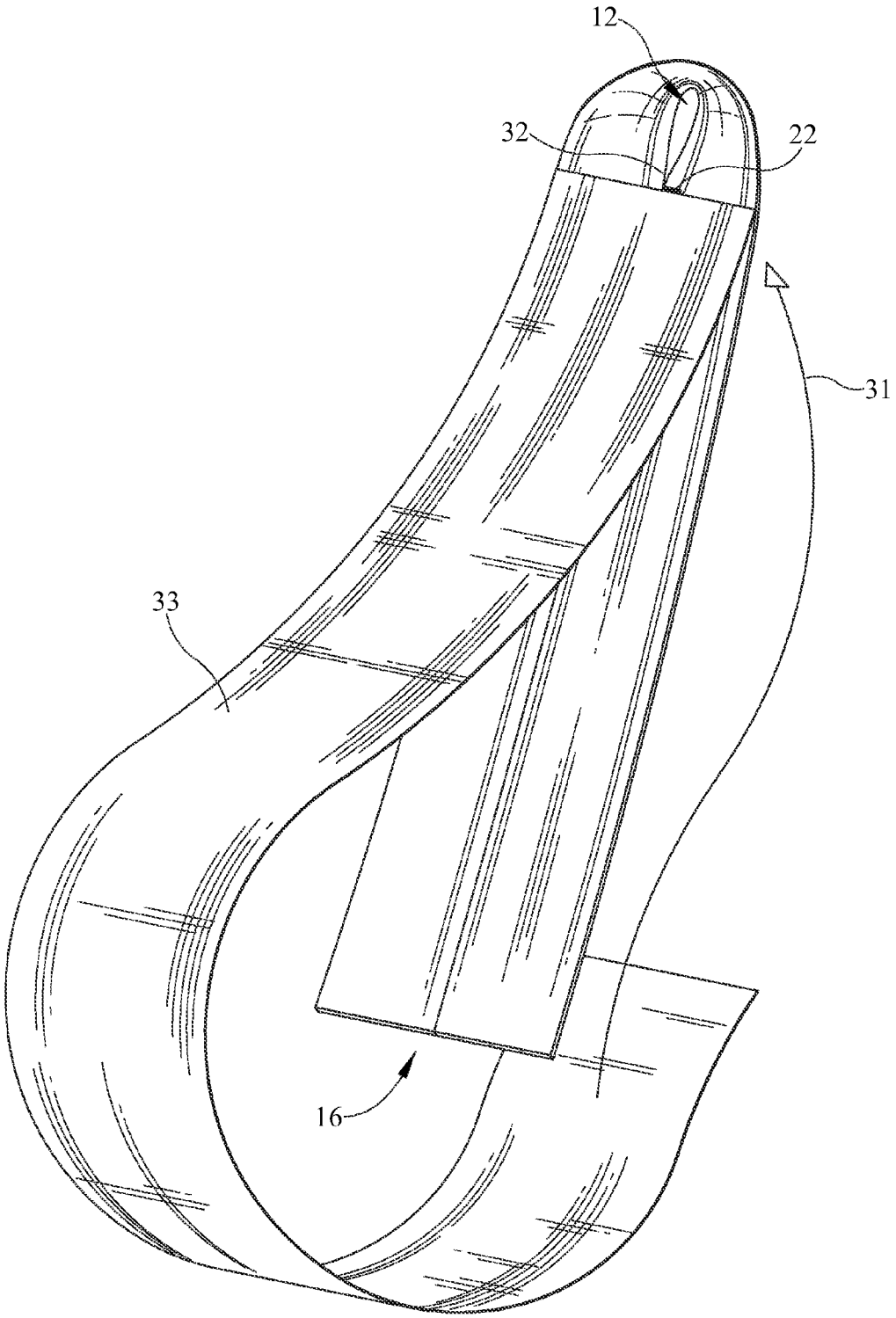
FIG. 4D is a perspective view of a finger loop assembly for a finger loop palm protector, according to multiple embodiments and alternatives.
Figure 4E:
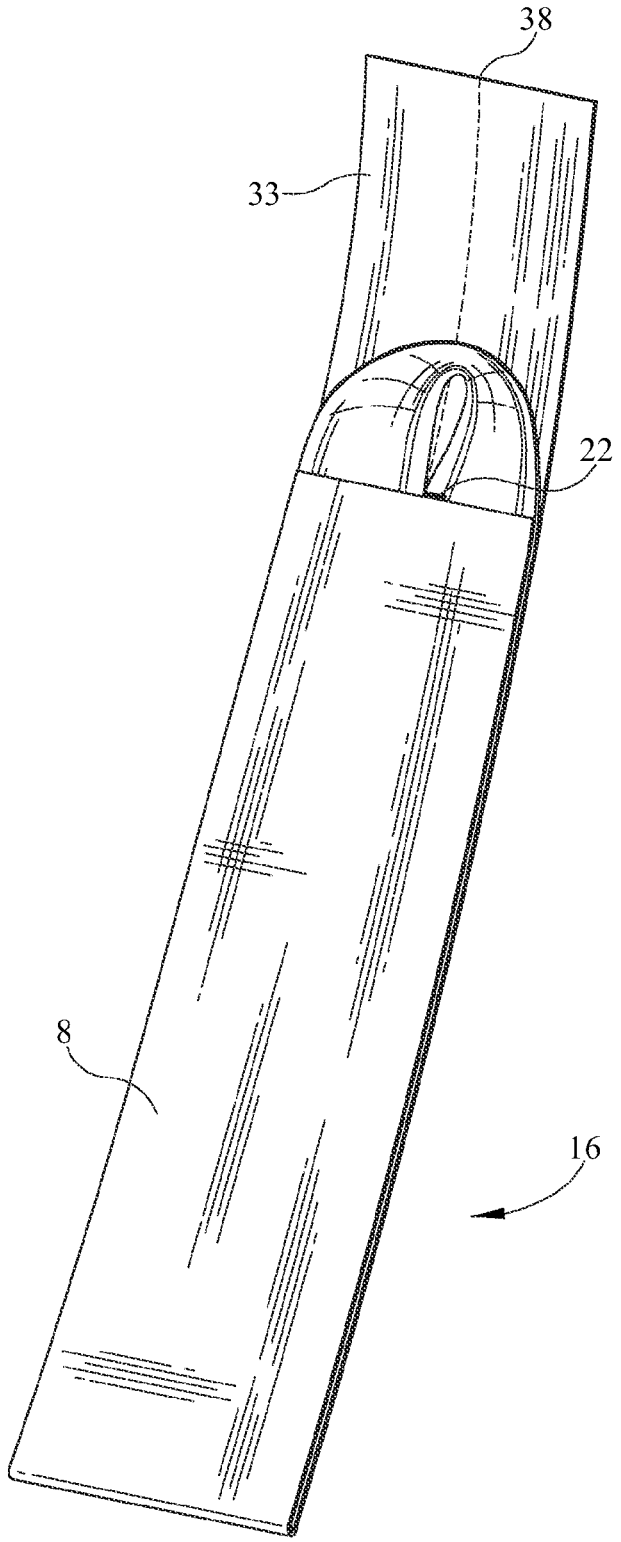
FIG. 4E is a perspective view of a finger loop assembly for a finger loop palm protector, according to multiple embodiments and alternatives.
Figure 5A:
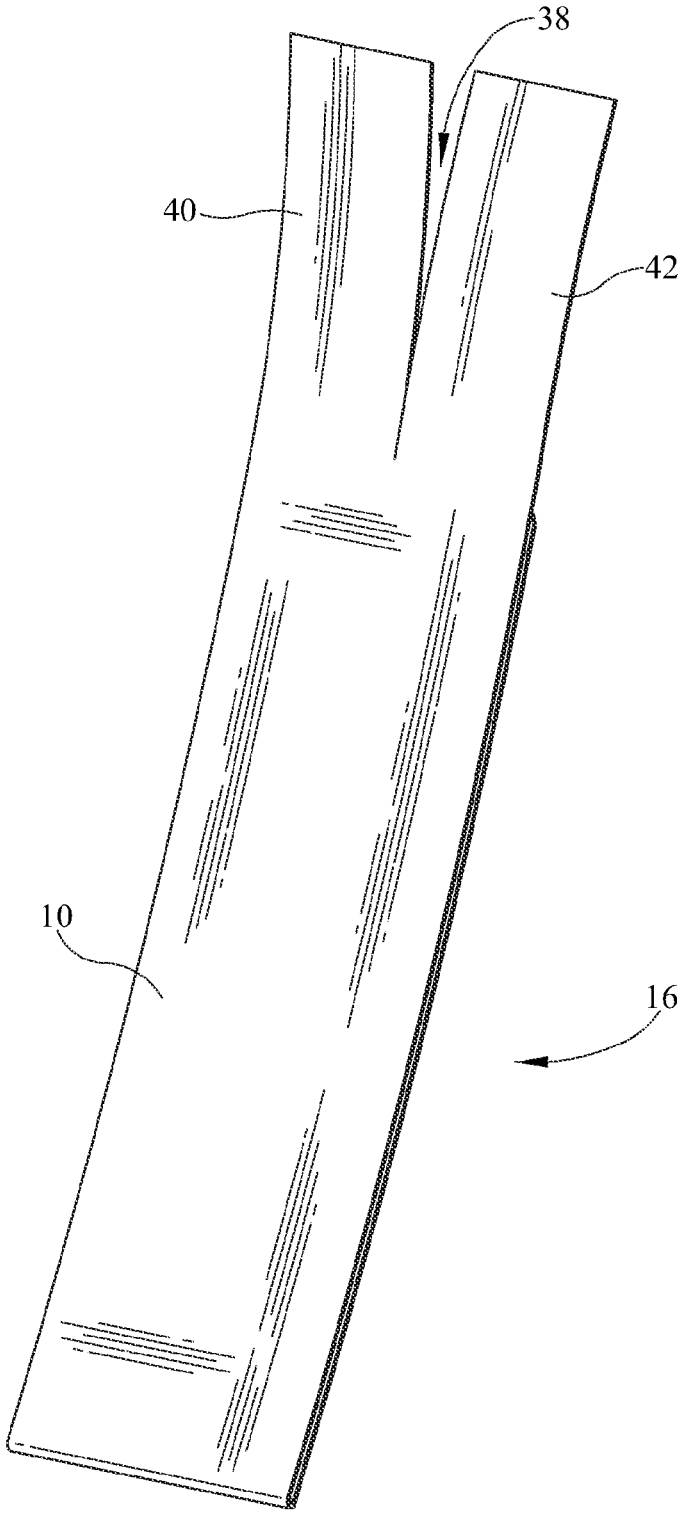
FIG. 5A is a perspective view of a finger loop assembly for a finger loop palm protector, according to multiple embodiments and alternatives.
Figure 5B:
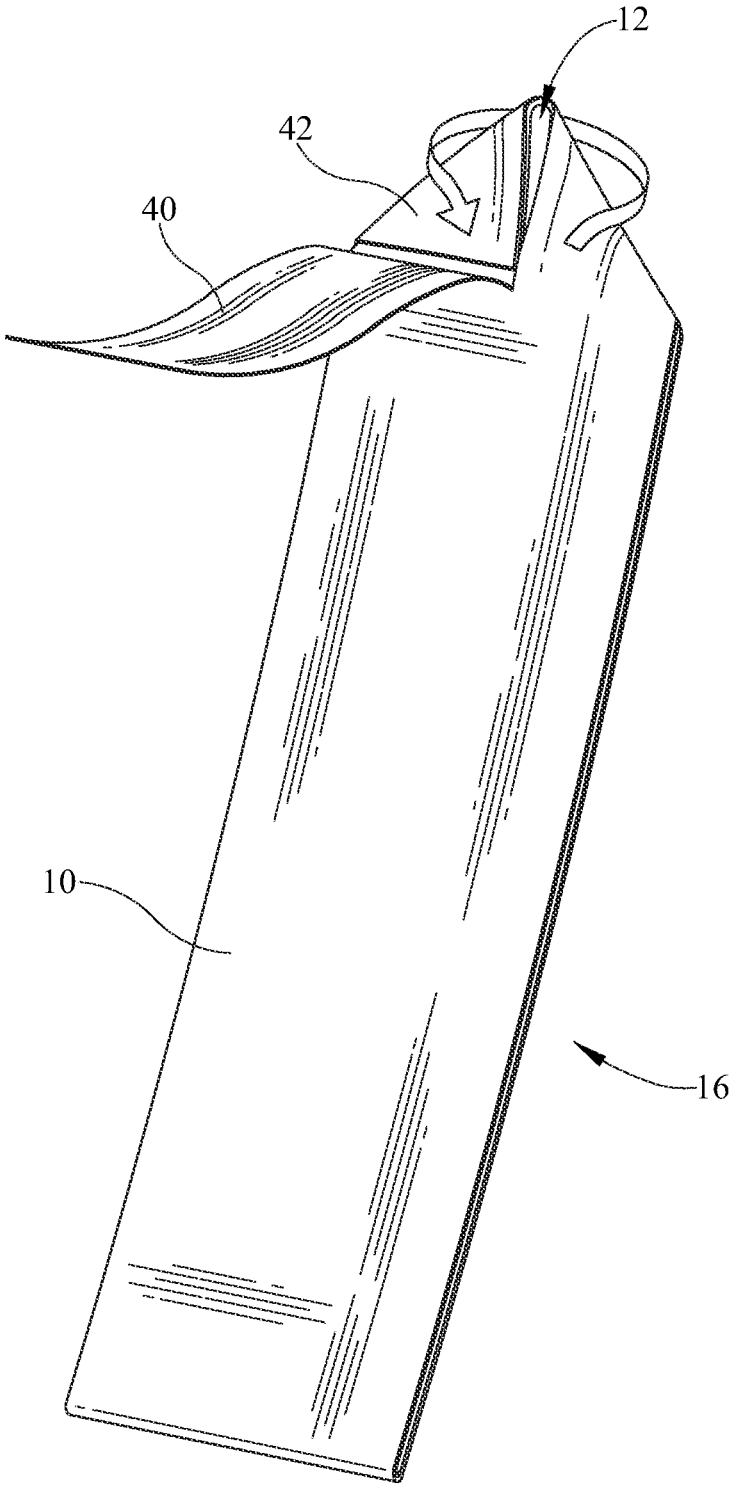
FIG. 5B is a perspective view of a finger loop assembly for a finger loop palm protector, according to multiple embodiments and alternatives.
Figure 5C:
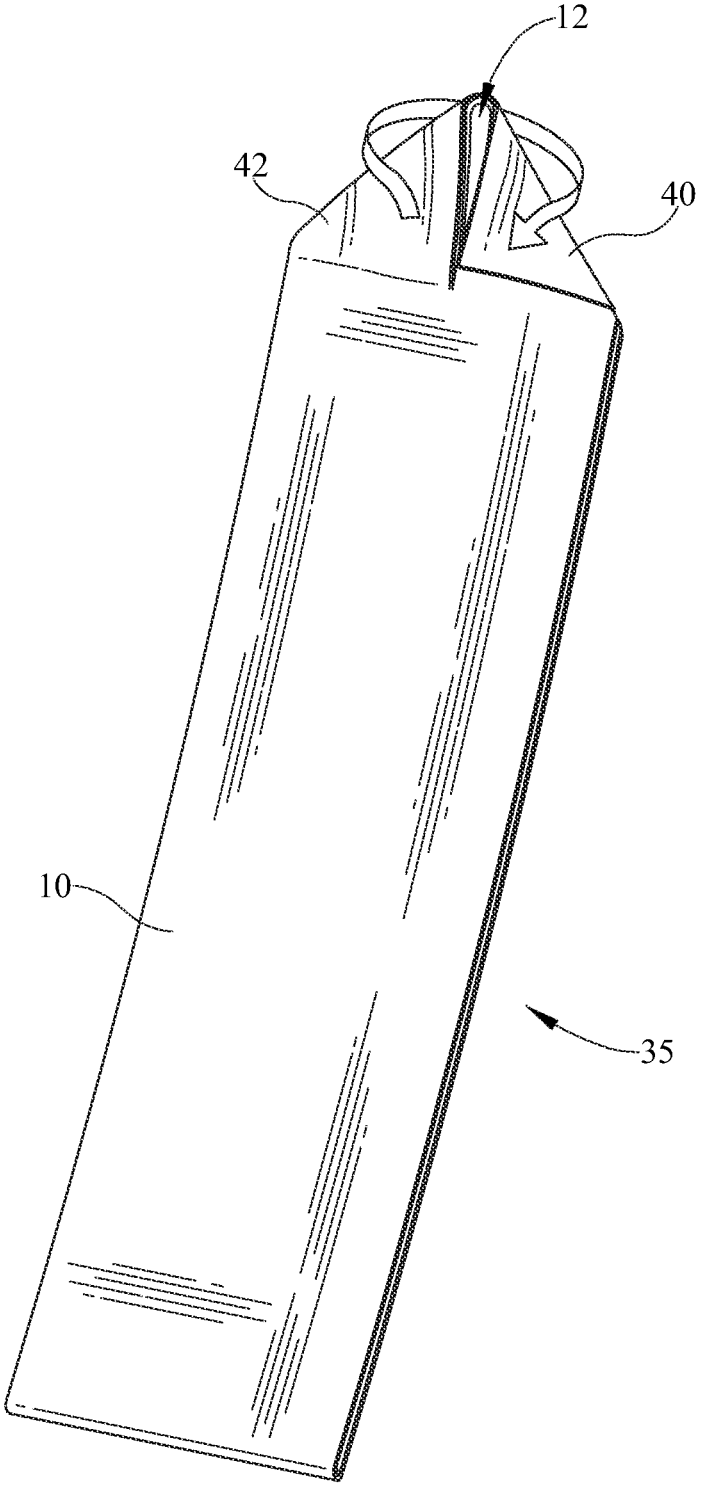
FIG. 5C is a perspective view of a finger loop assembly for a finger loop palm protector, according to multiple embodiments and alternatives.

As illustrated in FIG. 4D, in some embodiments the positioning of regions 25 and 26, respectively, of base strip 16, are secured with a securing adhesive strip 33. For this securing step of feature, a first edge of securing adhesive strip 33 is firmly placed at loop origin 32, corresponding with notch 22. It will be appreciated that strip 33 comprises a surface coated with an adhesive material, such as are customarily used in the manufacture of standard athletic tape. As desired, the securing adhesive strip 33 is then applied superficially over the two surfaces of base strip 16, as indicated by directional arrow 31. Optionally, after wrapping it around the wrist edge 27 and moving up the opposite surface, strip 33 may extend to cover the finger loop opening 12. For example, FIG. 4E shows an intermediate stage of development of a finger loop assembly 35, in which the securing adhesive strip 33 extends well past finger loop opening 12. For reference, FIG. 4E shows a base strip 16, with a portion of its palm-facing surface 8 visible. By comparison, other figures, including FIGS. 5A, 5B, and 5C, show the opposite, object-facing surface 10. As noted above, preferably securing adhesive strip 33 is applied to both of these surfaces.

Figure 4F:
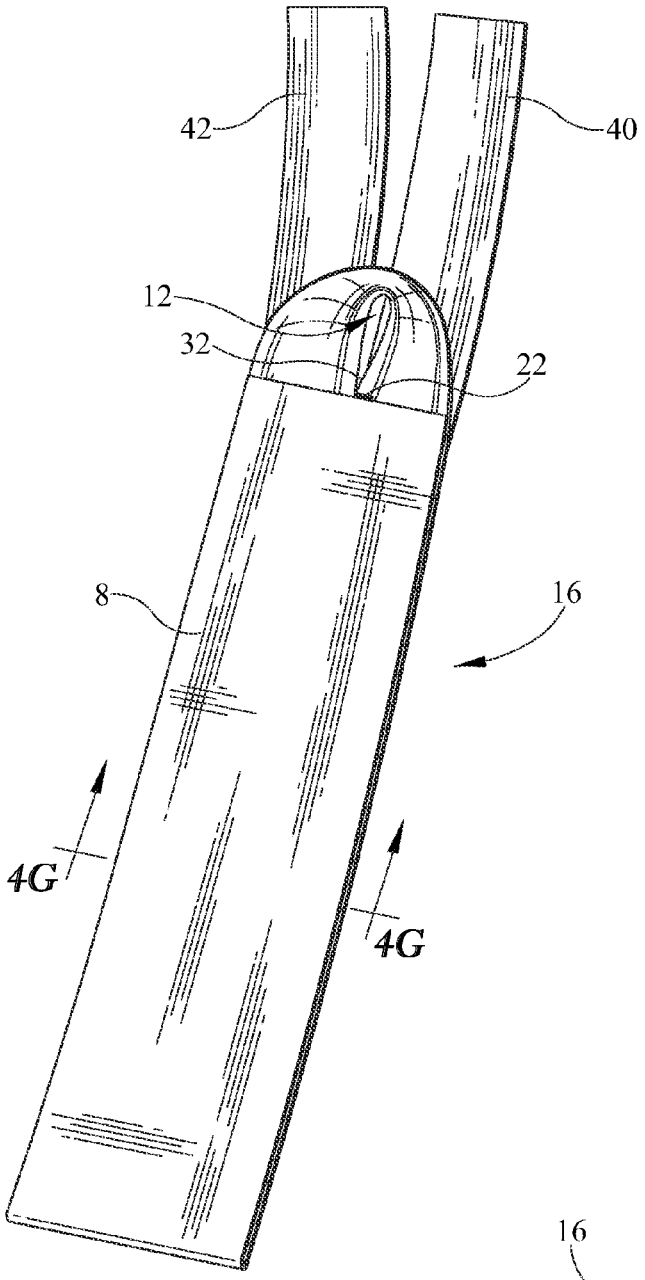
FIG. 4F is a perspective view of a finger loop assembly for a finger loop palm protector, according to multiple embodiments and alternatives.
Figure 4G:
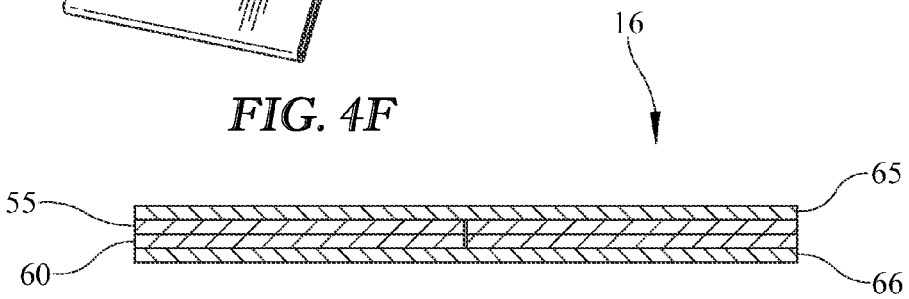
FIG. 4G is a cross-section view of a finger loop assembly for a finger loop palm protector, according to multiple embodiments and alternatives.

FIG. 4G provides a cross-section view of a base strip 16, according to multiple embodiments and alternatives, taken along line 4G-4G of FIG. 4F. Specifically, FIG. 4G shows a first base layer 55 along with second base layer 60, after doubling. In addition, FIG. 4G shows a first securing strip layer 65 and a second securing strip layer 66, consistent with application of securing adhesive strip 33 according to prior figures, e.g., FIGS. 4D, 4E, and 4F.

In some embodiments, FIGS. 4F, 5A, 5B, and 5C show how a portion of securing adhesive strip 33 is put to use for added reinforcement of first finger loop assembly 35. Specifically, FIG. 4F shows a base strip 16 including palm-facing surface 8. This figure illustrates finger loop opening 12 with its loop origin 32, the positioning of which corresponds with the location of the notch 22. FIG. 4E, FIG. 4F, and FIG. 5A, in particular, show how slicing a portion of securing strip 33 along a cut-down line 38 is performed to establish a first loop reinforcing portion 40 and a second loop reinforcing portion 42, respectively. The perspective of FIG. 5A illustrates the object-facing surface 10, while that of FIG. 4E and FIG. 4F illustrates the palm-facing surface 8.

In FIG. 5B, the object-facing perspective shows how the second loop reinforcing portion 42 is maneuvered in curvilinear fashion around a portion of the object-facing surface 10, thus adding reinforcement to the loop portion of base strip 16. The finger loop opening 12 is visible in FIG. 5B, as is the first loop reinforcing portion 40 of first securing adhesive strip 33. FIG. 5C is also from the same perspective as FIG. 5B, but now indicating how first loop reinforcing portion 40 is maneuvered in curvilinear fashion to add additional reinforcement to the finger loop opening 12. Given that portions 40, 42 are part of securing adhesive strip 33, these portions have a surface coated with an adhesive material, which is used to bind portions 40, 42 to a portion of the object-facing surface 10 that forms a boundary of loop opening 12.

Accordingly, FIG. 5C shows a completed first finger loop assembly 35 according to an embodiment. However, it will be appreciated that the first loop reinforcing portion 40 and second loop reinforcing portion 42 are optional. If they are not to be used, in that event preferably no part of the securing adhesive strip 33 extends along the object-facing surface 10 as to cover or block the finger loop opening 12.

Figure 6A:
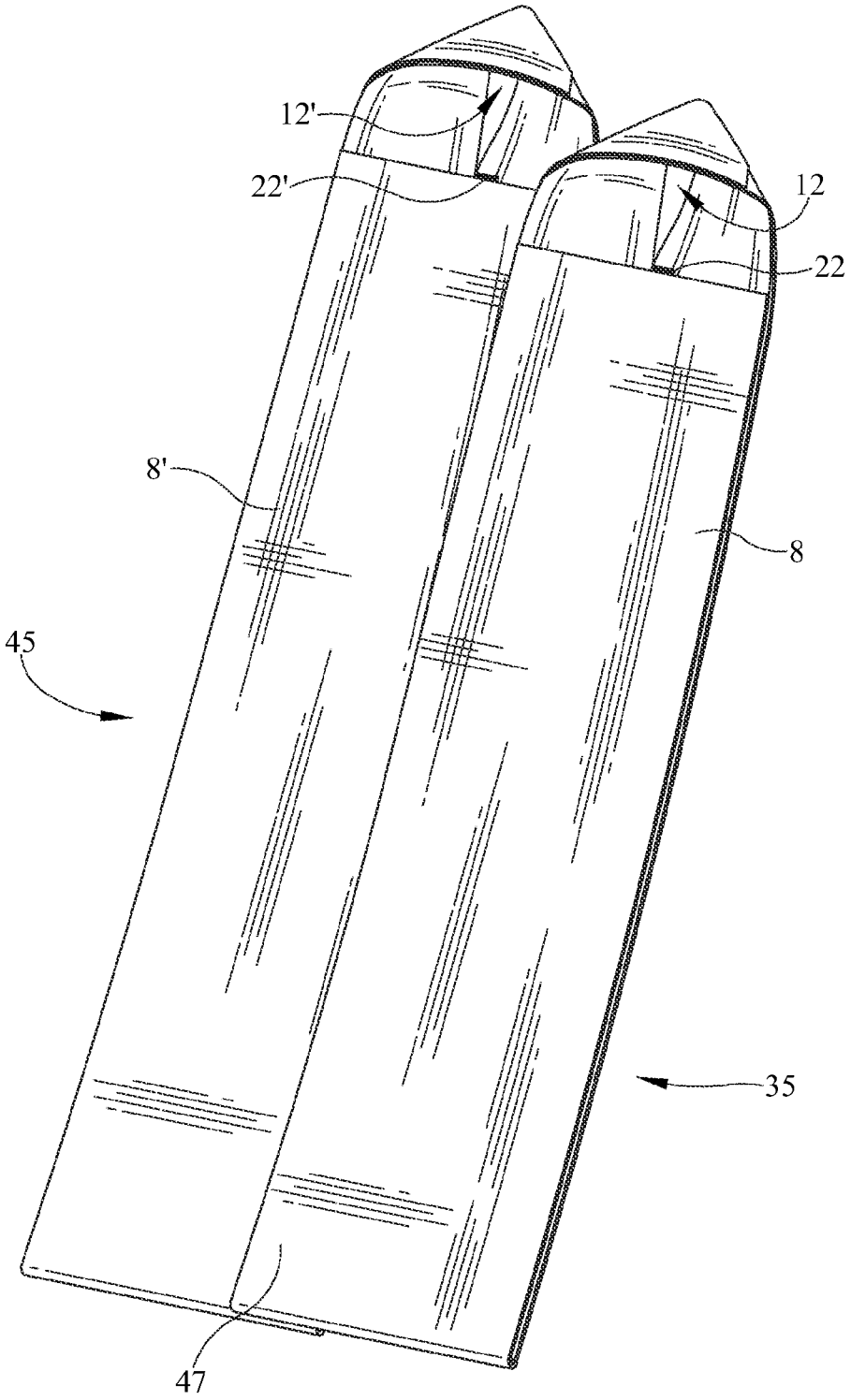
FIG. 6A is a perspective view of finger loop assemblies for a finger loop palm protector, according to multiple embodiments and alternatives.

FIG. 6A shows first finger loop assembly 35 and a second finger loop assembly 45, which is formed through the same maneuvers from similar starting materials as first assembly 35. Like parts on the second finger loop assembly 45 are designated as primes of the corresponding structures on first finger loop assembly 35.

Figure 6B:
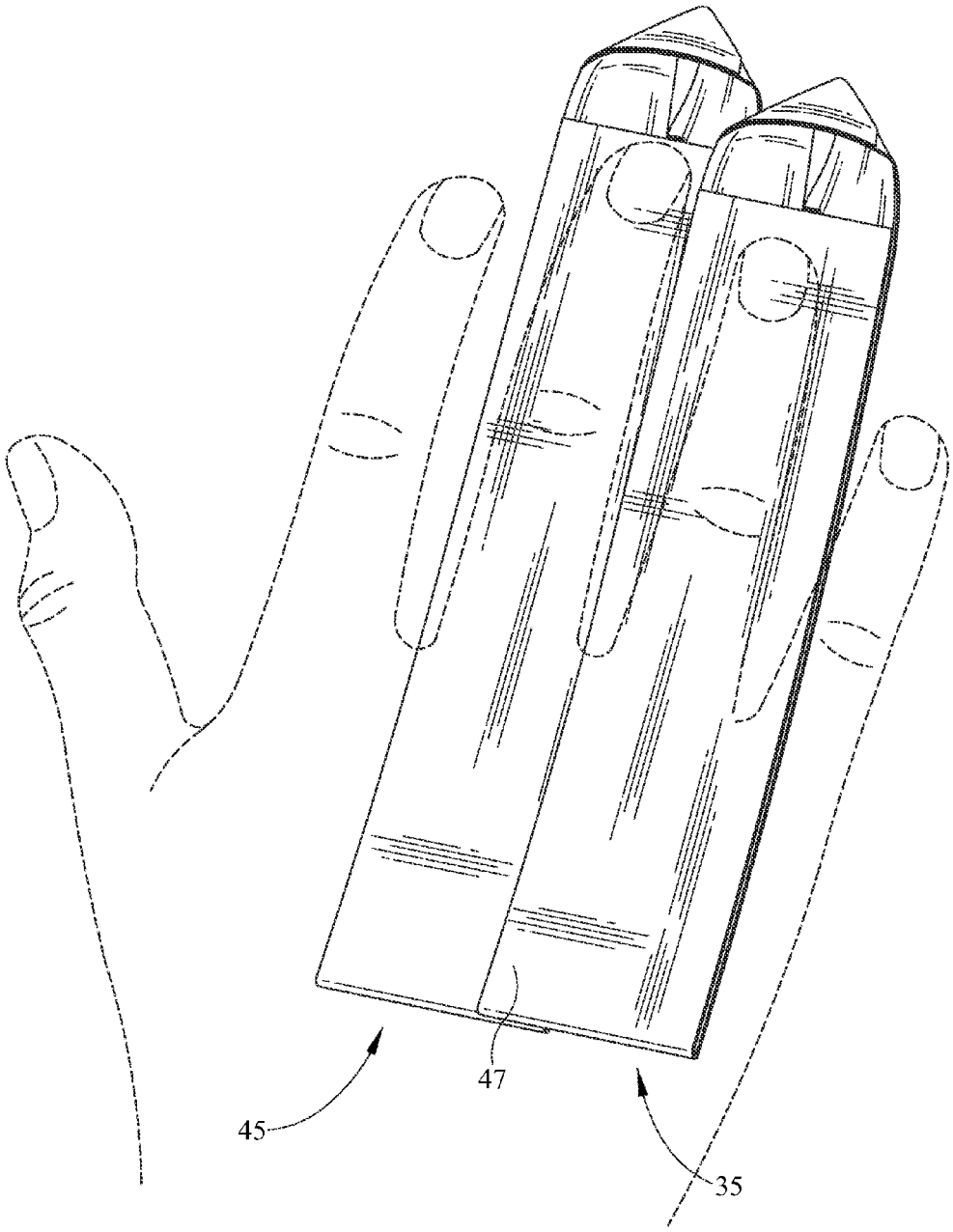
FIG. 6B is a perspective view of finger loop assemblies for a finger loop palm protector, according to multiple embodiments and alternatives.

In some embodiments, there is a difference in length of base strip 15 chosen as starting material. As noted above, this is because the strip for the third finger is about ½ in. longer than the strip for the ring finger. With reference back to an earlier figure, FIG. 1 shows a finger loop palm protector 5 looping over two fingers of a user (specifically, the third finger and the ring finger). Although these two fingers are preferred, the embodiments are not limited by the number of fingers, or which fingers, are inserted through the finger loop opening(s) 12. From the perspective of FIG. 6A, there is a palm-facing surface 8, 8', on both of first and second assemblies, 35, 45. The view taken here coincides with how the finger loop palm protector 5 will be worn by a user. In this view, as previously noted, finger loop opening 12 is for insertion of a user's finger. For added support and thickness. FIG. 6A illustrates an overlay region 47, which is shared between first and second assemblies 35, 45, and is created by placing a portion of one finger loop assembly atop the other. As protector 5 will be worn, the arrangement of FIG. 6A is further shown in FIG. 6B, only with the user's fingers illustrated with broken lines.

Figure 6C:
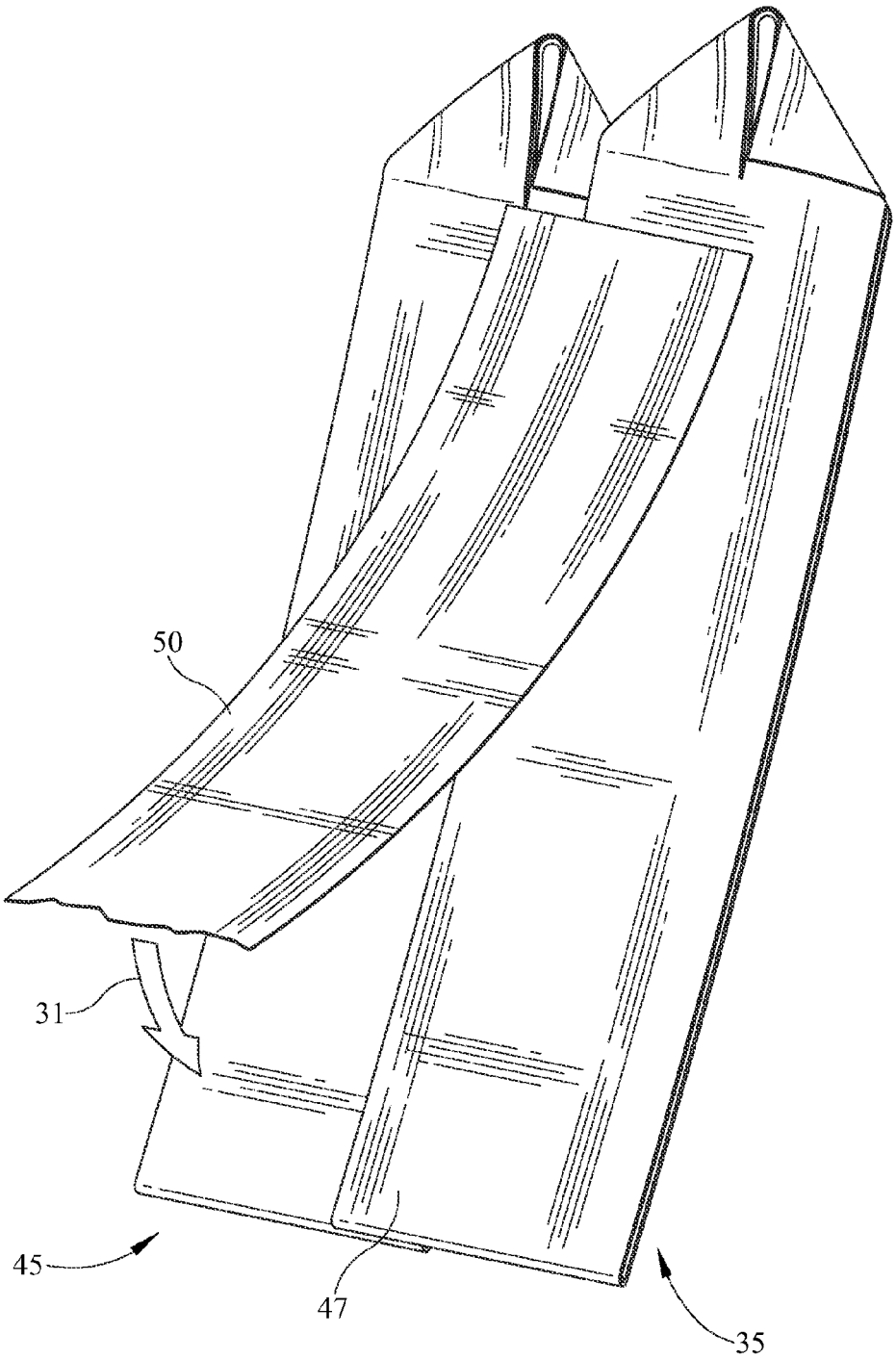
FIG. 6C is a perspective view of a finger loop palm protector, according to multiple embodiments and alternatives.

FIG. 6C shows the finger loop palm protector 5 ready to be completed. With first finger loop assembly 35 overlaying second finger loop assembly 45 about region 47, a reinforcing adhesive strip 50 is wrapped over both surfaces, 8, 10, according to directional arrow 31 as seen first in FIG. 6C and also in FIG. 6D. It will be appreciated that strip 50 comprises a surface coated with an adhesive material, such as are customarily used in the manufacture of standard athletic tape. Optionally, the engagement of the reinforcing adhesive strip 50 with the two finger loop assemblies begins on object-facing surface 10, and then extends around to the palm-facing surface 8. However, the embodiments are not limited by which surface the reinforcing adhesive strip 50 covers first. After completing the engagement of the reinforcing adhesive strip 50 over both surfaces 8 and 10, the finger loop palm protector 5 is completed and consists of first finger loop assembly 35 and second finger loop assembly 45 operationally engaged and fixed together with the reinforcing adhesive strip 50 to statically maintain the two assemblies in actual contact. In various figures, finger loop opening 12 corresponds positionally to origin 32 (e.g., shown in FIG. 4D and FIG. 4F), this origin being locatable in reference to notch 22. As shown in FIG. 2, a second finger loop palm protector 5' can be formed in like fashion to the first, for use on the second hand during competition and training. The protectors 5, 5' provide durable, customizable (to the individual user's hand size), and reusable protection of the palm against chafing, rubbing, and other problems identified previously.

Figure 6D:
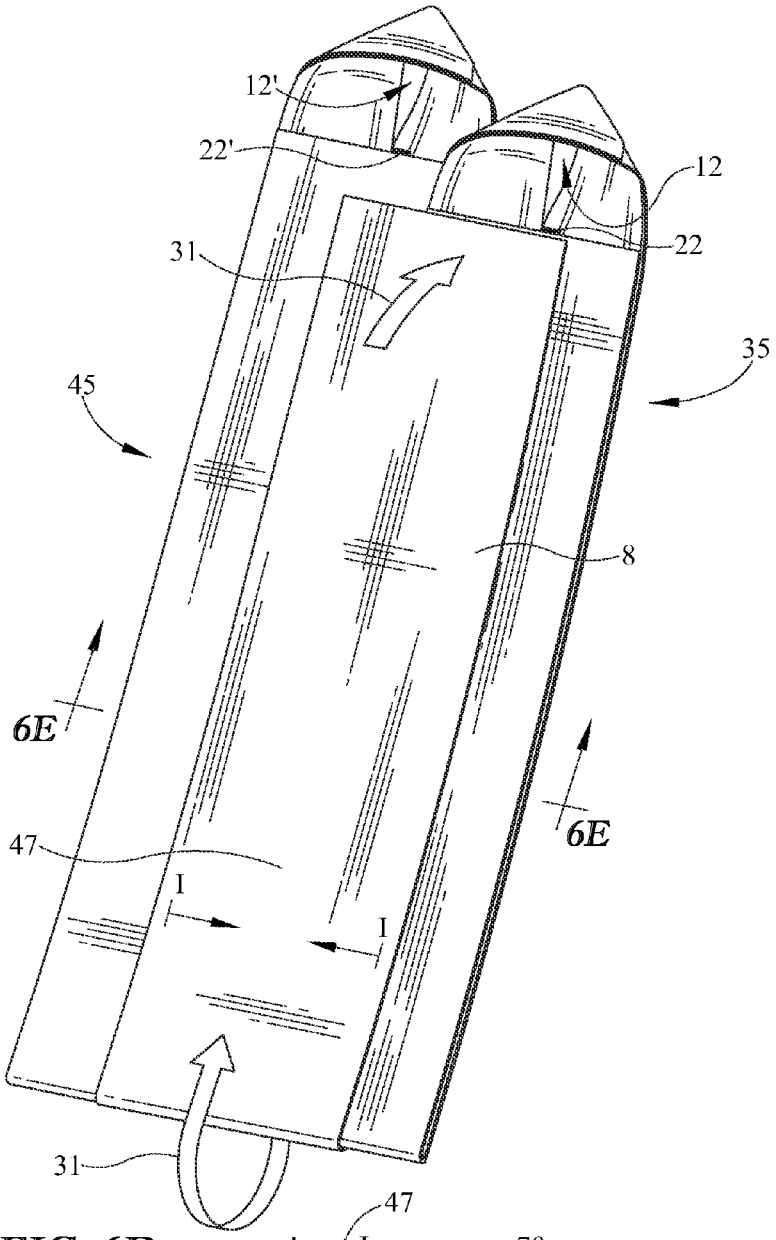
FIG. 6D is a perspective view of a finger loop palm protector, according to multiple embodiments and alternatives.
Figure 6E:
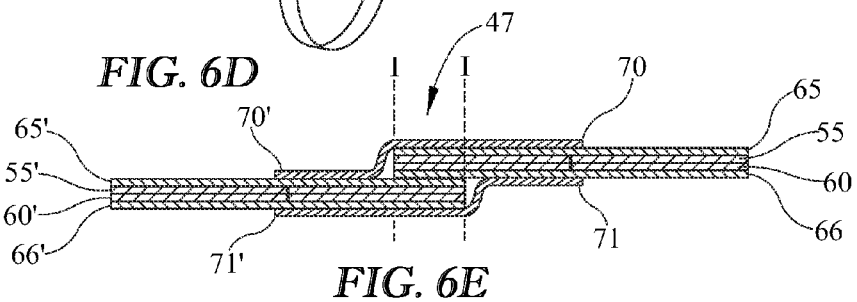
FIG. 6E is a cross-section view of a finger loop palm protector, according to multiple embodiments and alternatives.

FIG. 6E is a cross-section view of the finger loop palm protector 5, taken along the line 6E-6E in FIG. 6D. FIG. 6E shows ten different layers according to certain embodiments and alternatives as disclosed herein. The thickest region includes overlay region 47, which corresponds to line I-I in FIG. 6D. Specific layers in FIG. 6E are denoted by the reference numerals (previously identified) 55, 60, 65, 66, 70, 71 and 55', 60', 65', 66', 70', 71' with those indicated using primes being associated with second finger loop assembly 45 and having like names as to corresponding numerals with finger loop assembly 35.

It will be understood that the embodiments described herein are not limited in their application to the specific details of the teachings and descriptions set forth, or as illustrated in the accompanying figures. Rather, it will be understood that the present embodiments and alternatives, as described and claimed herein, are capable of being practiced or carried out in various ways. The foregoing descriptions of several embodiments and alternatives are meant to illustrate, rather than to serve as limits on the scope of what has been disclosed herein. It will be understood by those having ordinary skill in the art that modifications and variations of these embodiments are reasonably possible in light of the above teachings and descriptions. Accordingly, the words and phrases used herein are for the purpose of description and should not be regarded as limiting. The use herein of "including," "comprising," "e.g.," "containing," or "having" and variations of those words is not meant to limit the scope of the embodiments, but rather is meant to encompass the items listed thereafter, and equivalents of those, as well as additional items.

What is claimed is:

1. A finger loop assembly palm protector, comprising:

a base strip of material suitable for use as a hand wrap;

the base strip having a first end and a second end, wherein, in a first configuration, the base strip is substantially linear and having a midpoint between the first end and second end, wherein the base strip is designed to be arranged in a second, articulated configuration by pivoting, in the first configuration, a portion of the base strip that includes a first articulating edge region about the midpoint or substantially near the midpoint and bringing the first articulating edge region into substantial contact with a second articulating edge region of the base strip, thereby forming a finger loop assembly having a finger loop opening;

a securing adhesive strip operationally engaged with the base strip in the articulated configuration, for statically maintaining positioning of the first articulating edge region in substantial direct contact with the second articulating edge region;

wherein the base strip has a notch formed between the first end and the second end, for locating an origin of the finger loop opening;

a second finger loop assembly formed from a second base strip of material; and a reinforcing adhesive strip operationally engaged to statically maintain the finger loop assembly and the second finger loop assembly in actual direct contact about a shared overlay region.

2. The finger loop assembly palm protector of claim 1, wherein the notch is positioned on the base strip a predetermined distance from the midpoint, the distance being associated with a measurable dimension of a user's finger.

3. The finger loop assembly palm protector of claim 1, wherein at least a portion of the first articulating edge region contacts at least a portion of the second articulating edge region.

4. The finger loop assembly palm protector of claim 1, wherein a surface of the base strip contains an adhesive coating.

5. The finger loop assembly palm protector of claim 1, wherein the finger loop assembly palm protector is capable of covering a portion of the palm of a user's hand while the user grasps an object with the hand.

6. The finger loop assembly palm protector of claim 1, wherein the finger loop assembly palm protector comprises at least ten layers of material formed from a combination of material suitable for use as a hand wrap, securing adhesive strip, and reinforcing adhesive strip.

7. The finger loop assembly palm protector of claim 1, comprising only two finger loop assemblies.

8. A method of forming a finger loop palm protector from base strips formed from a material suitable for use as a hand wrap, which have a first end and a second end, and are designed to be in a first configuration that is substantially linear and having a midpoint between the first and the second end, the method comprising:

arranging a base strip in a second, articulated configuration, by pivoting, in the first configuration, a portion of the base strip that includes a first articulating edge region about the midpoint or substantially near the midpoint and bringing the first articulating edge region into substantial direct contact with a second articulating edge region of the base strip, thereby forming a finger loop assembly having a finger loop opening;

applying a securing adhesive strip over the base strip in the articulated configuration, for statically maintaining positioning of the first articulating edge region in substantial contact with the second articulating edge region;

wherein the base strip has a notch formed between the first end and the second end, for locating an origin of the finger loop opening;

forming a second finger loop assembly from a second base strip of material;

arranging a portion of one of the finger loop assemblies atop a portion of the other finger loop assembly to form a shared overlay region; and applying a reinforcing adhesive strip over the finger loop assemblies to statically maintain actual direct contact between the finger loop assemblies.

9. The method of claim 8, further comprising measuring a dimension of a finger of the intended user.

10. The method of claim 9, further comprising associating the measurement of the finger of the intended user with the positioning of the notch.

11. The method of claim 8, wherein for each finger loop assembly the area of the finger loop opening varies proportionally in accordance with the distance between the notch and the midpoint of the base strip.

12. The method of claim 8, wherein a first edge of the securing adhesive strip is positioned corresponding with the notch on the base strip.

* * * * *